United States Patent [19]

Oliphant

[11] Patent Number: 4,930,237

[45] Date of Patent: Jun. 5, 1990

[54] POSTER BOARD DISPLAY SYSTEM

[76] Inventor: Eric B. Oliphant, P.O. Box 2667, Santa Fe, N. Mex. 87504

[21] Appl. No.: 673,674

[22] Filed: Nov. 21, 1984

[51] Int. Cl.[5] ..... G09F 7/02

[52] U.S. Cl. ..... 40/617; 40/618

[58] Field of Search ..... 40/618, 124.4, 617; 248/467

[56] References Cited

U.S. PATENT DOCUMENTS

| | | | |
|---|---|---|---|
| 1,496,282 | 6/1924 | Taylor | 248/467 |
| 2,338,426 | 1/1944 | Gloecker | 434/430 |
| 2,492,411 | 12/1949 | Barnes | 248/467 |
| 2,554,408 | 5/1951 | Hile | 40/620 |
| 2,914,873 | 12/1959 | Brennan | 40/594 |
| 3,316,669 | 5/1967 | Machbar | 40/618 |
| 3,797,135 | 3/1974 | Linker et al. | 434/428 |
| 4,133,123 | 1/1979 | Anderson | 40/1 |
| 4,333,253 | 6/1982 | Cooper | 40/642 |
| 4,393,612 | 7/1983 | Clark | 40/152 |
| 4,403,000 | 9/1983 | Gates | 427/206 |
| 4,425,724 | 1/1984 | Scott | 40/124.4 |

FOREIGN PATENT DOCUMENTS

| | | | |
|---|---|---|---|
| 1245458 | 9/1971 | United Kingdom | 40/617 |

*Primary Examiner*—Kenneth J. Dorner
*Assistant Examiner*—J. R. Hakomaki
*Attorney, Agent, or Firm*—Robert B. Stevenson

[57] ABSTRACT

A poster board wall display system comprising a foamed polystyrene board, smaller than the poster board to be hung to the wall, with an opening having a tapered or slanted upper edge to engage a fastener (e.g., nail or hook) protruding from the wall. The outer face of the foamed polystyrene board is equipped with a fastener means (e.g., VELCRO strip) that reversibly engages to the backside of the poster board. In this manner, a poster board can be suspended away from the wall during display and the particular poster boards being displayed can be readily repositioned or changed.

3 Claims, 1 Drawing Sheet

POSTER BOARD DISPLAY SYSTEM

BACKGROUND OF THE INVENTION

1. Field of the Invention

This invention relates to an improved poster board wall display system. More specifically, the invention relates to a free hanging, lightweight, poster board support that adjustably mounts to the wall and detachably suspends a poster board away from the wall for display purposes.

2. Description of the Prior Art

The basic concept of displaying lightweight poster board containing lithographic prints or the like can be closely correlated to the general practice employed in displaying other works of art by hanging them on the wall. Thus, it is known to generally hang a poster board on a wall by use of various types of picture hangers and fasteners whether the poster board with lithographic print is framed or unframed. However, because of the poster board's inherent lack of significant mass and because of the aesthetics of lithographic art, it would be preferable to employ a method of hanging such art work wherein the print is left unframed, readily replaceable or repositionable and, as the inventor of the present application has discovered, displaced and suspended away from the wall. However, prior to the present invention, no generally known or accepted system for achieving these goals was readily available to the artists or art studios.

SUMMARY OF THE INVENTION

In view of the prior art methods and systems for hanging and displaying poster boards, I have discovered an improved poster board wall display apparatus and system comprising:

(a) an essentially planar foamed plastic support means of smaller dimensions than the poster board to be displayed and of thickness corresponding to the desired distance away from the wall that the poster board is to be held during display;

(b) an opening through the upper portion of the foamed plastic support means wherein the upper surface of the opening is an essentially flat surface sloped to one side forming a sharp edge against the wall during use such as to engage a fastener extending from the wall; and (c) a fastener means on the outer surface of the foamed plastic support means above the opening adapted to reversibly engage to and hold the poster board during display.

Preferably, according to the present invention, the planar foamed plastic support means is a foamed polystyrene sheet and the fastener means is a strip of VELCRO-like material attached to the outer face of the foamed polystyrene and the backside of the poster board.

It is an object of the present invention to provide a poster board wall display system and apparatus that is lightweight, easy to mount to the wall and remove from the wall and capable of suspending a poster board essentially parallel to the wall, but displaced away from the wall without the use of an additional frame. It is a further object of the present invention to provide such a poster board wall display system and apparatus that is relatively economical, simple to use, yet reliable. Fulfillment of these objects and the presence and fulfillment of additional objects will be apparent upon complete reading of the specification and claims taken in conjunction with the drawings.

DESCRIPTION OF THE PREFERRED EMBODIMENTS

Figure 1:
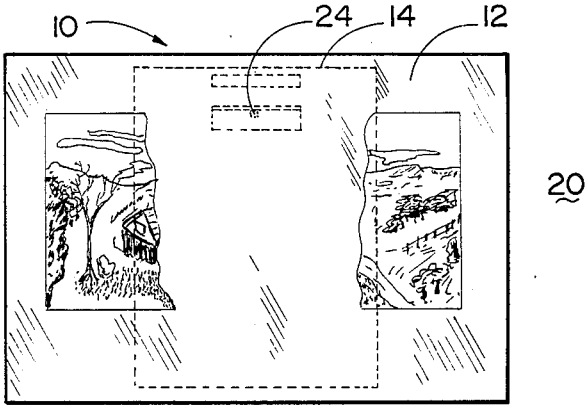
FIG. 1 illustrates a poster board being displayed by use of the silhouetted poster board display system according to the present invention.
Figure 2:
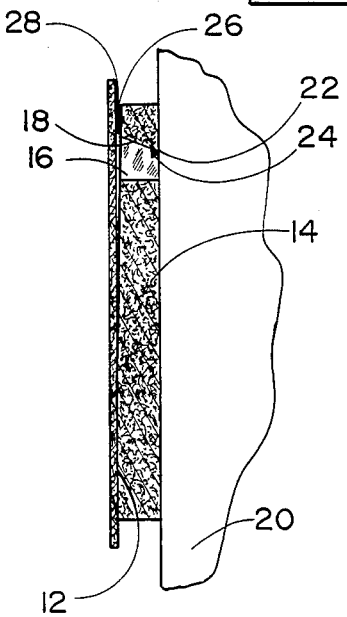
FIG. 2 is a cross-sectional side view of the poster board display system, and poster board of FIG. 1 as seen through line II—II.

The poster board wall display system and apparatus according to the present invention, how it functions, how it differs from prior art systems and the advantages associated with its use can perhaps be best explained and understood by reference to the drawings. FIG. 1 illustrates lithographic print on a poster board suspended away from a wall during display by use of the poster board wall display apparatus, generally designated by the numeral 10, according to the present invention. During use, the poster board 12 is held suspended away from the wall 20 by virtue of the presence of a light-weight foamed plastic sheet 14 (see silhouette of FIG. 1, partial cut-away side view of FIG. 2 and FIG. 3) As further illustrated, this light-weight, foamed plastic sheet 14 contains a rectangular opening 16 displaced on the upper portion of the foamed sheet 14. As seen in FIG. 2, the upper surface 18 of the opening 16 is sloped or slanted such as to approach the wall 20 at an acute angle or sharp edge 22. The edge 22 engages with a conventional nail 24 and because of the sharp angle and relative soft foam involved, the edge 22 is readily adjustable to maintain the display poster board in a desired level configuration.

Figure 3:
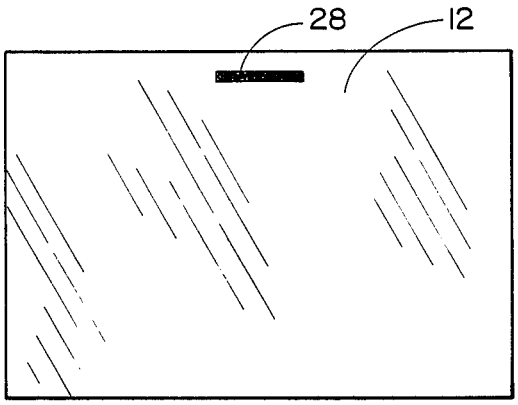
FIG. 3 is a perspective view of a foamed polystyrene poster board support means according to the present invention.
Figure 4:
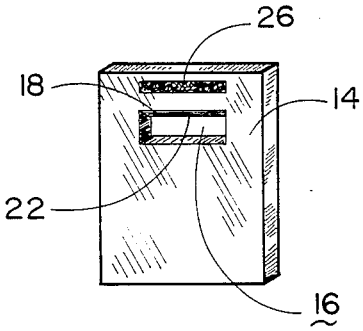
FIG. 4 illustrates the backside of the poster board to be attached to the poster board support means of FIG. 3.

Above the opening 16 on the outer face of the foamed plastic sheet 14 (see FIG. 3) is one half of a VELCRO-like fastener 26 that operatively attaches to a compatible VELCRO-like fastener 28 (see FIG. 4) mounted to the upper backside of poster board 12. In this manner, a poster board can be readily attached to the foamed plastic support means and then the composite can be hung on a conventional hook or nail driven into the wall. If a poster board is to be either replaced or repositioned, the entire structure can be removed and the VELCRO fasteners separated, as illustrated in FIGS. 3 and 4, thus allowing the selection of poster boards being displayed at any one given time to be readily changed.

The actual selection of materials and method employed to construct the poster board support 14 according to the present invention can be from any of the lightweight materials and corresponding methods of fabrication as well known in the plastic fabrication art. Preferably, a foamed, lightweight cellular material is employed, including by way of example, but not limited thereto, foamed polystyrene, beaded foamed polystyrene, foamed polyurethane or other cellularly expanded foams. Preferably, a beaded foamed polystyrene having a nominal density of about one and one-half pounds per cubic foot is preferred. Such materials can be purchased in either sheet form or blocks. The desired shape and size can then be fabricated by hot wire cutting technique or the like. Alternatively, the preferred beaded foamed polystyrene article can be fabricated in a mold corresponding to the desired shape and size for the poster board support.

Preferably, the poster board support according to the present invention is selected to be smaller in dimensions than the poster board attached thereto. However, it is contemplated that the support could be intentionally larger, if desired, and if appropriately designed to serve as a decorative boarder for the poster board. Also, the thickness of the poster board support is selected such as to hold the poster board at the desired distance away from the wall. Usually a fraction of ar: inch to a few inches is appropriate for most applications. Preferably, about one and a quarter inch thickness is adequate for most applications. The actual shape and size of the poster board support can vary according to the particular application. It has been discovered that a polystyrene foamed poster board of about eighteen inches by twenty-four inches is compatible with most poster board lithographic displays.

A somewhat smaller polystyrene foamed poster board support of about fifteen and a half inches wide, seventeen inches high and one and a fourth inches thick is also particularly convenient for displaying lithographic or mechanical serigraph prints. In each of the above foamed poster board supports, an opening of about two and a half inches high and about six inches long centrally displaced about two and a half inches from the top of the edge of the support with the upper edge of the opening sloping back to the wall at about a sixty degree angle has proved to be appropriate for most applications.

The method of attaching the poster board support to the wall can be by any compatible fastener means as well known in the art consistent with providing a protrusion or extension away from the wall that engages the upper edge of the opening in the poster board support. Similarly, the VELCRO-type fastener used to reversibly secure the poster board to the poster board support can be any such device as generally known in the art and can be attached to the respective items by any of the methods generally known. Preferably, a VELCRO strip of about one inch wide by six inches long glued to the (either hot melt or solvent) support and poster board has been found to be sufficient for most lithographic poster board display purposes. Similarly, the poster board itself can be any such device as generally known in the art, including the contemporary lightweight foamed core poster board with lithographic prints laminated on one side.

Having thus described the invention with a certain degree of particularity, it is manifest that many changes may be made in the details of construction and the arrangement of components without departing from the spirit and scope of this disclosure. Therefore, it is to be understood that the invention is not limited to the embodiment set forth herein for the purposes cf exemplification, but is to be limited only by the scope of the attached claims, including a full range of equivalents to which each element thereof is entitled.

I claim:

1. A poster board wall display apparatus comprising:

(a) an essentially planar foamed plastic support means of smaller dimensions than the poster board to be displayed and of thickness corresponding to the desired distance away from the wall that the poster board is to be held during display;

(b) an opening through the upper portion of said foamed plastic support means wherein the upper surface of said opening is an essentially flat surface sloped to one side forming a sharp edge against the wall during use such as to engage a fastener extending from the wall;

(c) a fastener means on the outer surface of said foamed plastic support means above said opening adapted to reversibly engage to and hold the poster board during display; and (d) a poster board.

2. A poster board wall display apparatus of claim 1 wherein said foamed plastic is foamed polystyrene.

3. A poster board wall display apparatus of claim 2 wherein said fastener means is a plastic fastening tape consisting of mating hooked and looped strips.

* * * * *